US010536790B2

(12) United States Patent
Lu et al.

(10) Patent No.: US 10,536,790 B2
(45) Date of Patent: Jan. 14, 2020

(54) LOCATION BASED SERVICES AUDIO SYSTEM

(71) Applicant: Startimes Software Technology Co. Ltd., Beijing (CN)

(72) Inventors: Yao Lu, La Jolla, CA (US); Jiangtao Wen, Walnut, CA (US)

(73) Assignee: StarTime Software Technology Co., Ltd., Beijing (CN)

( * ) Notice: Subject to any disclaimer, the term of this patent is extended or adjusted under 35 U.S.C. 154(b) by 0 days.

(21) Appl. No.: 15/557,414

(22) PCT Filed: Mar. 10, 2016

(86) PCT No.: PCT/US2016/021844

§ 371 (c)(1),
(2) Date: Sep. 11, 2017

(87) PCT Pub. No.: WO2016/145235

PCT Pub. Date: Sep. 15, 2016

(65) Prior Publication Data

US 2018/0115844 A1 Apr. 26, 2018

Related U.S. Application Data

(60) Provisional application No. 62/132,285, filed on Mar. 12, 2015.

(51) Int. Cl.
*H04R 27/00* (2006.01)
*H04R 3/12* (2006.01)

(52) U.S. Cl.
CPC ..... *H04R 27/00* (2013.01); *H04R 3/12* (2013.01); *H04R 2227/003* (2013.01); *H04R 2227/005* (2013.01); *H04R 2420/07* (2013.01); *H04R 2430/01* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 5,822,537 | A | 10/1998 | Katseff et al. | |
| 2007/0110074 | A1 | 5/2007 | Bradley et al. | |
| 2007/0297459 | A1 | 12/2007 | Cucos et al. | |
| 2014/0270235 | A1 | 9/2014 | Shin et al. | |
| 2015/0010167 | A1 | 1/2015 | Arling | |
| 2015/0195857 | A1* | 7/2015 | Pan | H04W 76/10 455/41.3 |
| 2015/0256926 | A1* | 9/2015 | Kim | H04R 3/12 381/81 |

OTHER PUBLICATIONS

International Search Report for International Application No. PCT/US2016/021844, dated Jun. 2, 2016, 1 page.

* cited by examiner

*Primary Examiner* — Paul W Huber
(74) *Attorney, Agent, or Firm* — Morgan, Lewis & Bockius LLP

(57) ABSTRACT

An audio system comprising a plurality of speaker devices allows seamless transitioning of playing audio between speakers in different locations. A mobile device may be used to determine a location for which the associated speakers should be used for playback. The speaker devices at the different locations may be synchronized to a common clock in order to allow the audio playback to be transitioned seamlessly from one location to another.

11 Claims, 11 Drawing Sheets

LOCATION BASED SERVICES AUDIO SYSTEM

RELATED APPLICATION

This application claims priority to U.S. Provisional Patent Application No. 62/132,285 filed Mar. 12, 2015, titled "Location Based Services Audio System", which is incorporated herein by reference in its entirety.

TECHNICAL FIELD

The current application is directed to audio systems and in particular to audio systems incorporating location based services.

BACKGROUND

Homes or other locations may include speakers in multiple different locations. A central audio receiver connected to the speakers in the different locations may allow audio to be played in the different locations. The central audio receiver may allow different audio to be played at the different locations.

An additional, alternative and/or improved audio system capable of playing audio to different locations is desirable.

SUMMARY

In accordance with the present disclosure there is provided an audio system comprising: a plurality of speaker devices each comprising: a network interface; a processing unit for executing instructions; a memory unit storing instructions, which when executed by the processing unit configure the respective speaker device to provide: a synchronization client for synchronizing an internal clock with a common clock; location based service (LBS) functionality for transmitting an LBS signal for use in determining a location of an external device; and media player client functionality for controlling playback of media based on one or more received playback commands; and a portable device comprising: a network interface; a processing unit for executing instructions; and a memory unit storing instructions, which when executed by the processing unit configure the portable device to provide: location based service (LBS) functionality for receiving the LBS signal transmitted by one or more of the plurality of speaker devices; and media player control functionality for transmitting playback commands to one or more media player clients.

In a further embodiment, the system further comprises an access point including NTP server functionality and player server functionality.

In a further embodiment of the system, one or more of the plurality of speaker devices and the portable device comprise NTP server functionality and player server functionality.

In a further embodiment of the system, the memory of the portable device further stores instructions for configuring the portable device to provide functionality for: determining a distance to one or more of the plurality of speaker devices based on the LBS signals received from the one or more of the plurality of speaker devices; and determining one or more of the plurality of speaker to playback media on.

In a further embodiment of the system, the memory of the portable device further stores instructions for configuring the portable device to provide functionality for: transitioning media playback from one or more of the plurality of speaker devices to one or more different speaker devices.

In a further embodiment of the system, transitioning media playback comprises: streaming media to the one or more different speaker devices; beginning playback of the media at a specified time of the synchronized internal clock; adjusting playback speed based on an amount of buffered media.

In a further embodiment of the system, adjusting playback speed comprises adjusting the playback speed according to playback speed factor $\alpha$:

$$\alpha = 1 + \frac{(buffer_{threshold} - buffer_{current})}{buffer_{threshold}},$$

where: $buffer_{threshold}$ is a buffer level required to sustain normal playback of the media; and $buffer_{current}$ is the current amount of media data in the buffer.

In a further embodiment of the system, the memory of the portable device further stores instructions for configuring the portable device to provide functionality for: adjusting a volume of one or more of the speaker devices playing back media based on a distance of the portable device from the respective speaker device.

In a further embodiment of the system, adjusting the volume comprises adjusting the volume according to:

$$L_n = L_0 + 10\log\left(\frac{d_0}{d_n}\right)$$

where: $L_0$ is a desired volume level, in dB, at a selected one of the plurality of speaker devices; $d_0$ is a distance from the portable device to the selected speaker device; $L_n$ is the volume of the $n^{th}$ speaker device in dB; and $d_n$ is a distance from the portable device to the $n^{th}$ speaker device, where the plurality of speaker devices, other than the selected speaker device, are enumerated from n=1 to N−1 with N being the number of speaker devices playing back media.

In a further embodiment of the system, rein the selected speaker device is the closest speaker device to the portable device.

In accordance with the present disclosure, there is further provided a method for controlling media playback at one or more speaker devices, the method comprising: playing back audio at a first speaker device of a plurality of speaker devices, the first speaker device associated with a first location;

detecting a location change of a mobile device from a first location to a second location based on one or more location based services (LBS) signals transmitted by a plurality of speaker devices; and transitioning media playback from the first speaker device to a second speaker device of the plurality of speaker devices associated with the second location.

In a further embodiment of the method, transitioning playback comprises stopping playback at the first speaker device and starting playback at the second speaker device.

In a further embodiment of the method, each of the speaker devices transmits LBS signals including a unique identifier associated with a location of the respective speaker device.

In a further embodiment of the method, each of speaker devices comprises a respective clock that is each synchronized to a common clock.

In a further embodiment of the method, transitioning media playback comprises: streaming media to the one or more different speaker devices; beginning playback of the media at a specified time of the synchronized internal clock; adjusting playback speed based on an amount of buffered media.

In a further embodiment of the method, adjusting playback speed comprises adjusting the playback speed according to playback speed factor $\alpha$:

$$\alpha = 1 + \frac{(buffer_{threshold} - buffer_{current})}{buffer_{threshold}}$$

where: $buffer_{threshold}$ is a buffer level required to sustain normal playback of the media; and $buffer_{current}$ is the current amount of media data in the buffer.

In a further embodiment, the method further comprises: adjusting a volume of one or more of the speaker devices playing back media based on a distance of the portable device from the respective speaker device.

In a further embodiment of the method, adjusting the volume comprises adjusting the volume according to:

$$L_n = L_0 + 10\log\left(\frac{d_0}{d_n}\right)$$

where: $L_0$ is a desired volume level, in dB, at a selected one of the plurality of speaker devices; $d_0$ is a distance from the portable device to the selected speaker device; $L_n$ is the volume of the $n^{th}$ speaker device in dB; and $d_n$ is a distance from the portable device to the $n^{th}$ speaker device, where the plurality of speaker devices, other than the selected speaker device, are enumerated from n=1 to N−1 with N being the number of speaker devices playing back media.

In accordance with the present disclosure, there is further provided a speaker device comprising: a network interface; a processing unit for executing instructions; a memory unit storing instructions, which when executed by the processing unit configure the respective speaker device to provide: a synchronization client for synchronizing an internal clock with a common clock; location based service (LBS) functionality for transmitting an LBS signal for use in determining a location of an external device; and media player client functionality for controlling playback of media based on one or more received playback commands In accordance with the present disclosure, there is further provided a portable device comprising: a network interface; a processing unit for executing instructions; and a memory unit storing instructions, which when executed by the processing unit configure the portable device to provide: location based service (LBS) functionality for receiving the LBS signal transmitted by one or more of the plurality of speaker devices; and media player control functionality for transmitting playback commands to one or more media player clients.

DETAILED DESCRIPTION

Figure 1:
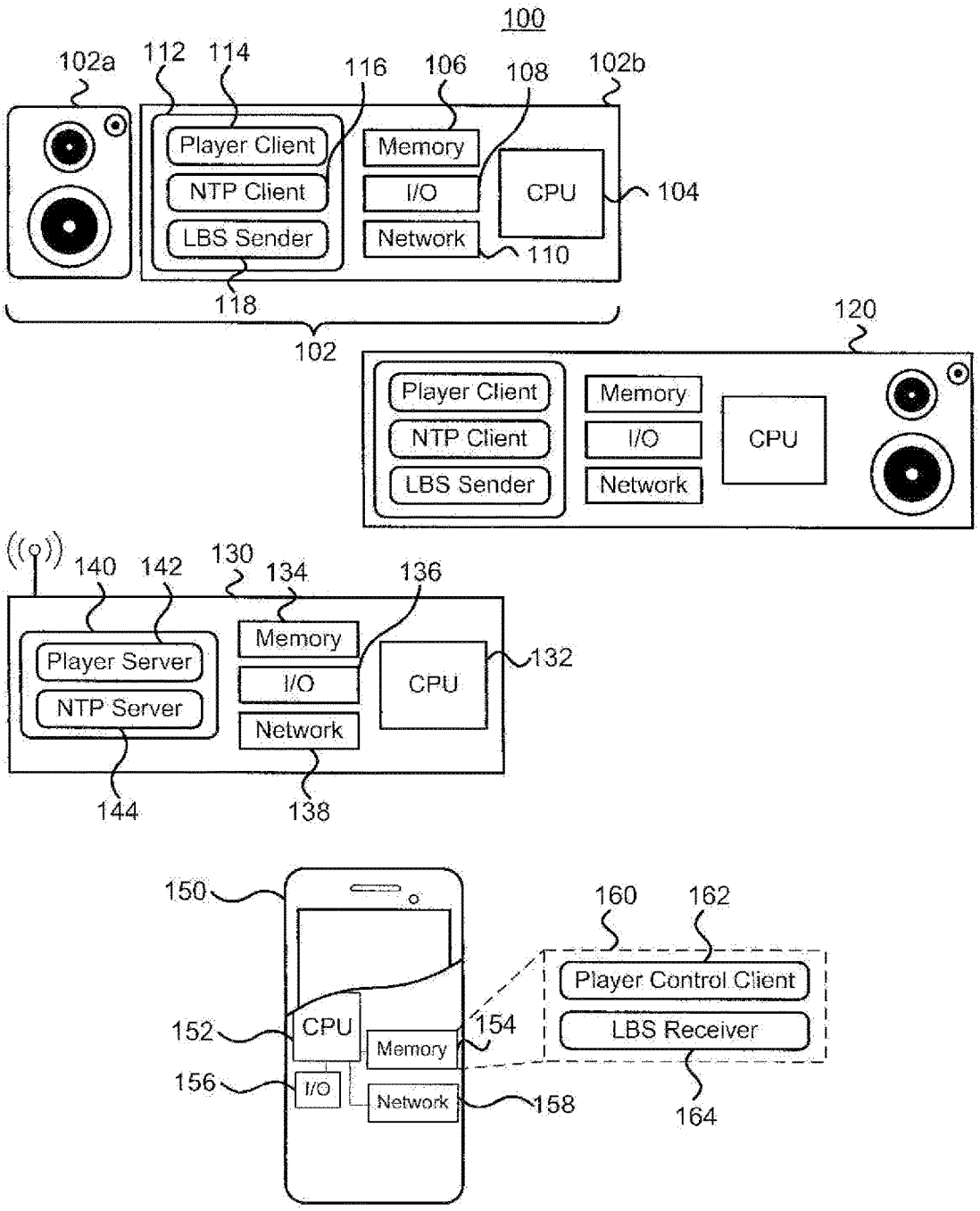
FIG. 1 depicts system components of a location based service (LBS) audio system.

An audio system may include a number of speakers in different locations. For example, in a home, speakers may be located in a living room, an office, an outdoor patio, etc. Audio can be played back over the different speakers from a central control device. For example, an individual may control the audio played back over the speakers in the different locations from a smart phone or other portable device. The user may select what audio is playing at the different locations. The speakers may be controlled to playback the same audio at one or more of the locations or may playback different audio to each location. Further, the audio playback may be controlled to provide automatic location switching so that the audio is played over speakers at different locations based on the location of the individual.

As described in further detail below, the audio system provides speaker devices that include a clock that can be synchronized with a central clock. All of the clocks of the speaker devices within a single audio system may have a time difference within, for example, 5 milliseconds. The synchronized speaker devices may provide seamless transitioning between different speaker locations so that music being played over the system can be switched to different speaker locations without interrupting the playback. The speaker devices may allow their locations, or the proximity to their locations to be determined. The location awareness may allow automatic transitioning from one speaker location to another based on a determined proximity of the user to the different speaker locations. For example, if the user is within a certain distance from a speaker location, the speaker will start playing automatically and when the user moves from a first location to a second location, the speaker that is in the first location will stop playing and the speaker in the second location will start playing. Although described as transitioning audio playback from speakers at a first location to a second location, it is possible for the playback to occur on the playback device or smart phone itself and transition to or from a speaker location. The playback device may be synchronized with the speaker locations, and any other devices. As audio playback is transitioned from one playback location to another, the volumes may be gradually reduced/increased to provide a smooth transition between playback locations.

An application may be provided, for example on the a user's smart phone, that allows a music play profile to be defined. The music play profile may specify playback control options. For example, the profile may specify that during a particular time, say 9:00 am to 5:00 pm the audio system should automatically play music based on the location of the user; while outside of the time, the playback locations should be specified by the user. Further, the application may allow a user to specify particular songs, artists, albums genres, playlists etc to play at a particular speaker location at specific times. For example, the application may allow a user to schedule a 'wakeup' playlist be played in a 'bedroom' location starting at 6:45 am. Additional schedules of playback locations, times and audio may be specified. The application may allow remote control of the audio system. The communication between components may be done over a network and as such communication can be achieved over any network, assuming that any intervening network components, such as firewall and/or NAT devices are configured to allow the appropriate traffic.

FIG. 1 depicts system components of a location based service (LBS) audio system. The system 100 comprises a number of different speaker devices 102, 120. Although only two different speaker devices 102, 120 are described herein, it will be apparent that more speaker devices may be incorporated into the audio system. The speaker devices may comprise a standard speaker 102*a* connected to a separate speaker device 102*b*, or the components may be located within a single physical device 120. Further, although only a single standard speaker 102*a* is depicted as being connected to the separate speaker device 102*b*, it is contemplated that a number of speakers could be connected to a single separate speaker device. The connections between the speakers and the separate speaker device may be provided by any number of known speaker connectors.

The separate speaker device 102*b* may comprise a processing unit 104 for executing instructions. The processing unit may be provided by a microcontroller or microprocessor. For example, the processing unit may be provided by 700 MHz single-core ARM processor, although other processors may be used. A memory unit 106 may store both data and instructions. The memory unit 106 may comprise a hierarchical memory structure, including registers, random access memory (RAM), read-only memory (ROM), flash-based memory devices, solid state drives (SSDs) and hard disk drives (HDDs). The separate speaker device 102*b* may further comprise input/output (I/O) interfaces 108 which may provide an interface to other components. For example the I/O connectors may provide an interface for connecting to the speakers 102*a*. The I/O interfaces may also provide wireless interfaces such as Bluetooth communication radios, including Bluetooth 4.0 chips, or other types of wireless communication including for example Zigbee, WiFi etc. The separate speaker device 102*b* may further comprise a network interface 110 for connecting to a network. The network connection may be provided by a wired or wireless network connection. Although the network connection may be considered as an I/O interface, it is described separately for clarity.

As described above, the separate speaker device 102*b* includes a processing unit 104 for executing instructions and a memory unit 106 for storing instructions. The instructions stored in the memory unit 106, when executed by the processing unit 104, configure the separate speaker device to provide various functionality 112, including player client functionality 114, a network time protocol (NTP) client functionality 116 and location based services (LBS) sender functionality 118.

The NTP client functionality 116 is responsible for synchronizing a clock of the separate speaker device 102*b* with a NTP Server. The LBS sender functionality 118 sends an LBS signal via a particular protocol, such as iBeacon protocol or Zigbee protocol, etc. that is used by a mobile device to determine the device's proximity to the separate speaker device transmitting the LBS signal. The player client functionality 114 is responsible for receiving streamed audio and control commands, such as play, pause, etc and carries the commands. The player client functionality 114 may receive commands, and streamed audio, from corresponding player server functionality.

The speaker device 120 is substantially the same as the speaker device 102 and as such the individual components are not described further. Although the components of speaker device 120 are substantially similar to those of speaker device 102, all of the components are provided within a single enclosure. That is the speaker device 120 combines the speaker 102*a* and the separate speaker device 102*b* as a single device.

The system 100 further comprises an access point player 130. The access point player 130 may be provided by a wireless access point or router that provides additional functionality. The wireless access point player 130 may comprise a processing unit 132 for executing instructions. The processing unit 132 may be provided by a microcontroller or microprocessor. A memory unit 134 may store both data and instructions. The memory unit 134 may comprise a hierarchical memory structure, including registers, random access memory (RAM), read-only memory (ROM), flash-based memory devices, solid state drives (SSDs) and hard disk drives (HDDs). The memory unit may provide sufficient storage for storing audio files for playback along with related metadata, such as art work etc. The access point player 130 may further comprise input/output (I/O) interfaces 136 which may provide an interface to other components. For example the I/O interface may provide an interface for connecting to external storage devices such as a USB drive. The access point player 130 may further comprise a network interface 138 for providing network connectivity to a plurality of devices.

As described above, the access point player 130 includes a processing unit 132 for executing instructions and a memory unit 134 for storing instructions. The instructions stored in the memory unit 134, when executed by the processing unit 132, configure the access point player 130 to provide various functionalities 140 in addition to the networking functionality typically provided by access points or routers. The functionalities 140 may include player server functionality 142 and NTP server functionality 144. The player server functionality 142 may receive player control command message over the network, which may be sent from, for example, an application running on a mobile devices. The player control server may process the message or may forward the message to one or more connected devices. For example, a "pause" command may cause the player server functionality to stop streaming audio to connected speaker devices. The player server functionality 142 may also be responsible for streaming audio music from the access point player 130 to connected devices. The access point player 130 may further comprise NTP server functionality 144 that allows the synchronizing of clocks of devices with NTP client functionality, such as speakers.

The audio system 100 further comprises a portable device such as a smart phone. The portable device 150 comprises a processing unit 152. The processing unit 152 may be provided by a microcontroller or microprocessor. For example, the processing unit may be provided by Snapdragon processor, and A8 processor or other processors. A memory unit 154 may store both data and instructions. The memory unit 154 may comprise a hierarchical memory structure, including registers, random access memory (RAM), read-only memory (ROM), flash-based memory devices, solid state drives (SSDs) and hard disk drives (HDDs). The portable device 150 may further comprise input/output (I/O) interface 156 which may provide an interface to other components. The I/O interface 156 may provide wireless interfaces such as Bluetooth communication radios, including Bluetooth 4.0 chips, or other types of wireless communication including for example Zigbee, WiFi etc. The portable device 150 may further comprise a network interface 158 for connecting to a network. The network connection may be provided by wired or wireless network connection. Although the network connection may be considered as an I/O interface, it is described separately for clarity. The network interface may be provided by one or more networks including WiFi networks, WiMax networks, cellular networks or other network types.

As described above, the mobile device includes a processing unit 152 for executing instructions and a memory unit 154 for storing instructions. The instructions stored in the memory unit 154, when executed by the processing unit 152, configure the portable device 150 to provide various functionality 160 including player control client functionality 162 and LBS receiver functionality 164. The player control client functionality 162 accepts user input of control commands such as play, pause, stop, song selection, location switching, etc, as well as providing a user interface. The player control client functionality 162 communicates with player server functionality 142. The LBS receiver functionality 164 receives LBS signals transmitted from LBS senders and determines the distance to the device sending the LBS signal. Example protocols that may support LBS Receiver and LBS Sender functionality are iBeacon protocol, Zigbee protocol, etc.

Figure 2:
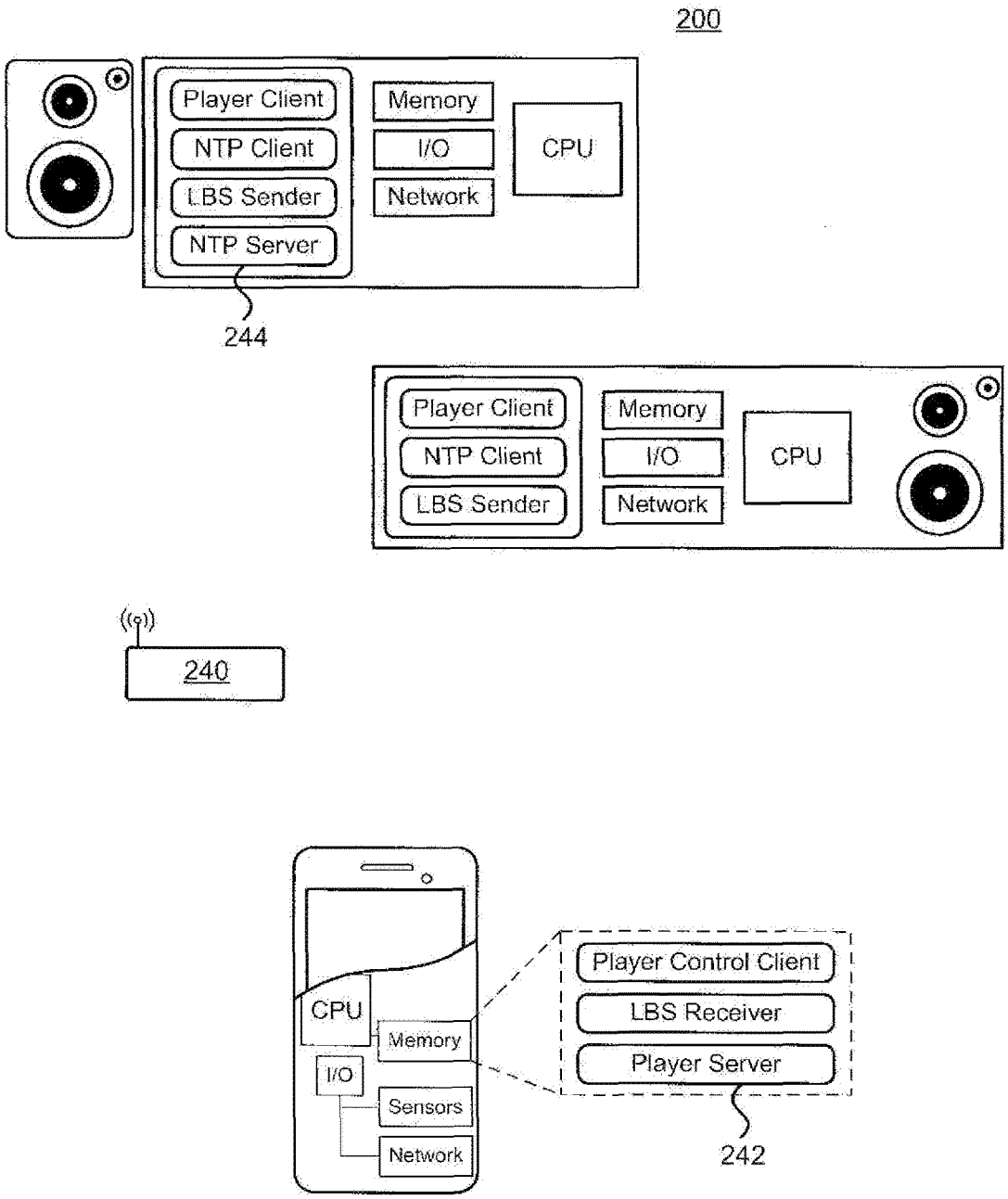
FIG. 2 depicts system components of a further location based service (LBS) audio system.
Figure 3:
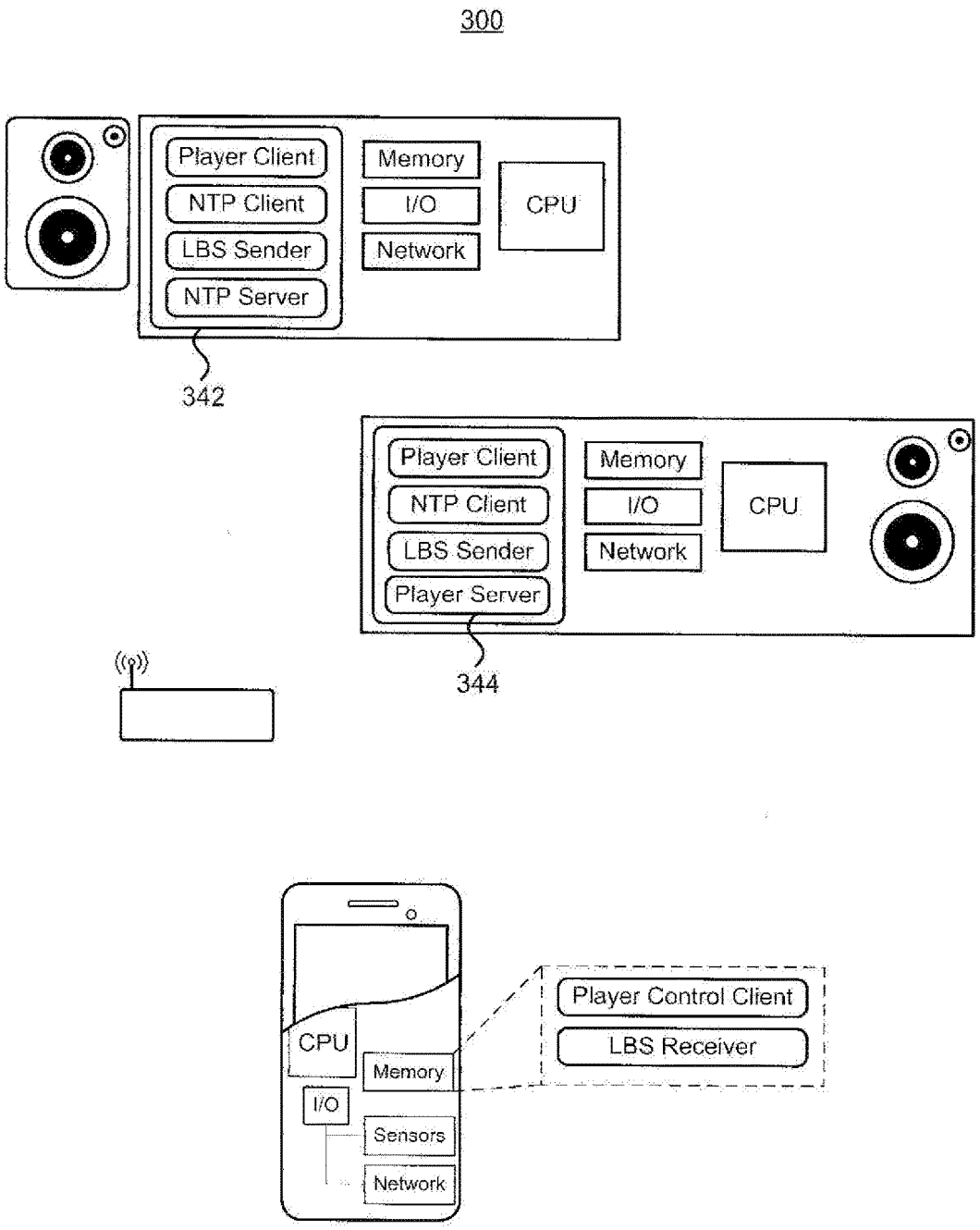
FIG. 3 depicts system components of a further location based service (LBS) audio system.

FIG. 2 depicts system components of a further location based service (LBS) audio system. The system 200 is similar to the system 100; however, instead of the access point player 130 that provides player server functionality 142 and the NTP server functionality 144, the system 200 utilizes an access point 240 that does not provide the additional functionality. Rather, as depicted, the player server functionality 242 is provided on the portable device 150 and the NTP server functionality 244 is provided by the separate speaker device 102*b*. Additionally, the portable device 150 may include an NTP client functionality 246 for synchronizing playback at the portable device with other devices including speakers. The player at the portable device may include a button, or other user interface component, FIG. 3 depicts system components of a further location based service (LBS) audio system. The system 300 is similar to the system 200 however, the player server functionality is provided on a speaker device such as the speaker device 120. Although the player server functionality 342 and the NTP server functionality 344 are depicted as being located on different speaker devices, it is contemplated that the player server functionality 342 and the NTP server 344 may be provided on the same device.

Figure 4:
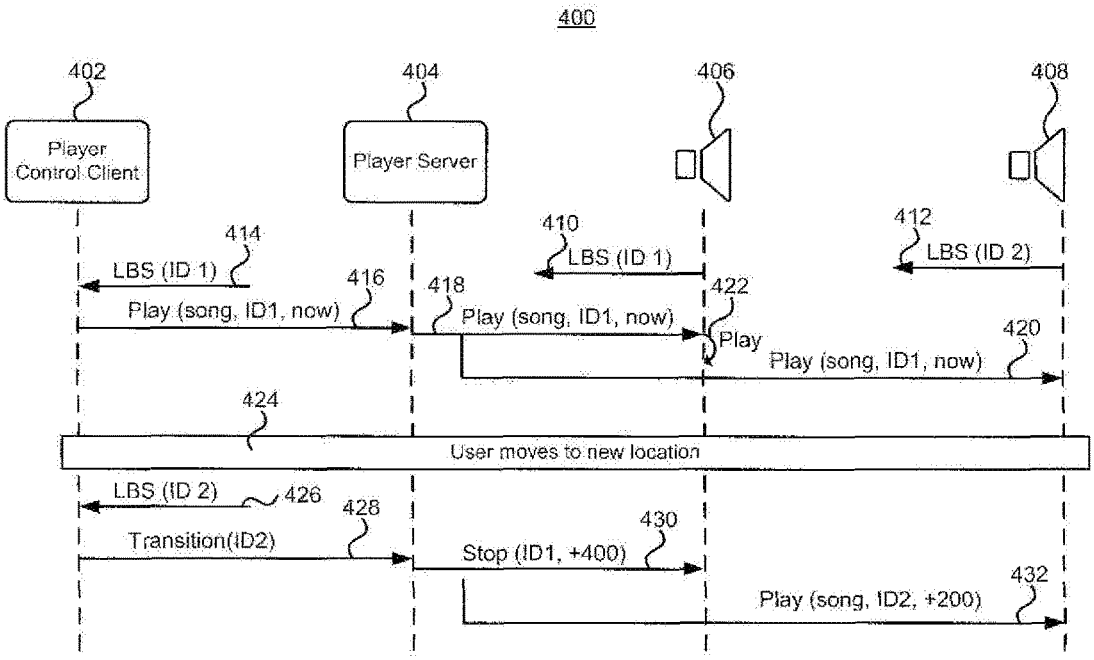
FIG. 4 depicts a process for a automatically selecting playback locations in an audio system.

FIG. 4 depicts a process for automatically selecting playback locations in an audio system. The audio system may be an audio system as described above with regard to FIG. 1, 2 or 3. The process 400 includes communication between player control client functionality 402, player server functionality 404, speaker device 406 at a first location and speaker device 408 at a second location. Although not depicted in FIG. 4, the speaker devices 406, 408 include NTP client functionality that communicates with NTP server functionality for synchronizing clocks and as such, the clocks of the speakers 406, 408 are synchronized with each other.

As depicted, each of the speaker devices 406, 408 broadcast location based service signals 410, 412 that include an identifier associated with the locations of the speaker devices 406, 408. The player control client 402 detects one or more of the LBS signals 414 and determines a relevant location based on the received signal. In FIG. 4, it is assumed that the user of the mobile device on which the LBS receiver functionality is present is in the location of the first speaker device 406. The player control client functionality 402 sends a player control command 416 to the player server functionality 404. As depicted the command is for playing a song. The command may specify the song or audio to play, a location to play the song in, which may be based on the determined location of the mobile device, as well as a time at which to carry out the command. The time to carry out the command may not be necessary when sending commands from the player control client functionality to the player server functionality. The player server functionality 404 receives the command and determines the how the command should be processed. As depicted, the player server functionality 404 may send the command 418, 420 to all speaker devices 406, 408. As depicted, the command may include the location ID that the command is for. When the command is received at the speaker device 422 with the correct location ID, the command may be processed 422, for example playing the identified audio. If the command is received at speaker devices that do not match the location ID of the command 420, the command may be processed at the speaker device; however, the command is not executed. For example, the speaker device 408 receives the command and although it does not begin streaming the identified song, it may note, or store, the time the song was to begin playing so that if the streaming is transitioned to the second speaker device, the song can be played at the correct location to provide a seamless transition.

When transitioning playback between devices, audio will need to be streamed over the network to the next playback device to start playing. However, if the network is congested the audio data may not arrive at the speaker by the time it needs to play the music. If the required audio data is not available when required to be played, the audio may stall or skip the missing data. Skipping or stalling playback may be avoided by ensuring the required audio data is available at the playback device by the time playback is required. In order to provide the audio data on time, streaming of the audio data to the speaker may begin before the user actually switches to the speaker. For example, when a user begins the process to select a playback location, streaming to one or more speakers, such as the nearest speaker or all speakers, may begin. When the user finally selects the speaker to transition playback to, the mobile device may still play the music for some time threshold, such as 1 second for example. This overlap time may be used to stream as much audio data to the speaker as possible. On the speaker or other synchronized playback device, if it does not receive enough audio data for playback at the appropriate time, that is the time the audio transition is to occur, playback may begin, however the audio may be slowed down in an attempt to allow more time to buffer the required amount of audio data. For example, the playback speaker may slow down the audio playback by a factor $\alpha$, which may be dynamically tuned according to the buffer level until the buffer level reaches the buffer threshold to playback at regular speed. Further, $\alpha$ may be slowly varied as playback returns to normal speed in order to mask the slowed playback from the user. If $\alpha$ is set to be 1, the playback speed is normal, that is 1 second audio segment is played back in 1 second. If $\alpha$ is set to 1.1 then the playback is slowed so that 1 second audio segment is played back in 1.1 seconds. $\alpha$ may be set according to:

$$\alpha = 1 + \frac{(buffer_{threshold} - buffer_{current})}{buffer_{threshold}}$$

Where:

$buffer_{threshold}$ is a buffer level required to sustain normal playback of the audio and may be based on a bit rate of the audio as well network conditions; and $buffer_{current}$ is the current amount of audio data in the buffer.

At some point, the user may move 424 to the location of the second speaker device 408. The mobile device, or more particularly the LBS receiver functionality, receives the LBS signal 426 and determines the location. Upon detecting the change in location, a transition command 428 may be sent from the player control client functionality 402 to the player server functionality 404. The transition command may include the new location identifier. The player server functionality 404 receives the transition command and sends commands to the speaker devices in order to carry out the transition. As depicted, the player server functionality 404 sends a stop command 430 to the speaker currently playing the audio and a play command 432 to the speaker at the new location. The stop and play commands may include an indication of when to carry out the command. As depicted, the play command may indicate that it should be carried out in 200 milliseconds from the current time and the stop command may indicate that it should be carried out in 400 milliseconds from the current time. By having the stop command carried out after the play command, the transition between speaker devices 406, 408 may be less noticeable. The transition between speaker locations may also be based on the proximity of the mobile device to a speaker location. For example, as the user moves closer to a location, the volume of the new location may be increased as the playback volume of the previous location is decreased.

As described, all the devices that are running NTP client functionality synchronize their clocks with the NTP Server functionality. The application running on the mobile device may send out a message indicating that it will start playing a song at time X. Because the clocks on all speaker devices are synchronized, all the speaker devices will receive the music and start playing the song at the same point in time. Due to network congestion or packet loss, the music data may be received after the time when it is assumed to be played, in that case, the packet will be dropped and only the music data that should be played at the specific time point will actually be played. Music data that is received prior to the time it is supposed to be played may be stored temporarily on the speaker devices.

The speaker devices may be registered with the access point player 130 so that the access point player can send data or commands to specific speaker devices. Alternatively, the speaker devices may not register with the access point player, but instead the access point player may broadcast commands and data to all devices connected to a particular unit. The access point and the speaker devices, and mobile device may support WiFi Protected Setup (WPS) to simply the setup of the system. A user may press a button on the speaker device, which causes the speaker device to scan for possible WiFi access points. The user may click a button in the player application, which causes the application to send a message to the access point enabling the WPS on the access point to allow the speaker devices to connect to the network.

The above has described audio playback as occurring on one playback device at a time, such as at a speaker location or at a the mobile device. However, the synchronization provided by the NTP functionality between devices may allow the audio playback on multiple devices simultaneously. Further, with the LBS functionality able to determine or at least estimate distances from the user, or the mobile device carried by the user, to the different speaker locations, it is possible to adjust the volume level of playback speakers so that the volume the user hears from each speaker is approximately equal. The mobile device may determine the distance to each speaker location and the mobile device. One speaker location may be selected as providing the desired volume level. The volume of the remaining speakers may be set according to:

$$L_n = L_0 + 10\log\left(\frac{d_0}{d_n}\right)$$

Where:

$L_0$ is the desired volume level, in dB, at the selected speaker location;

$d_0$ is the distance from the mobile device to the selected speaker location;

$L_n$ is the volume at the $n^{th}$ speaker location in dB; and $d_n$ is the distance from the mobile device to the $n^{th}$ speaker, where the speakers other than the selected speaker are enumerated from n=1 to N−1 with N being the number of speaker locations.

The speaker volumes may be periodically updated, for example once a second, based on movement of the user or mobile device.

Figure 5:
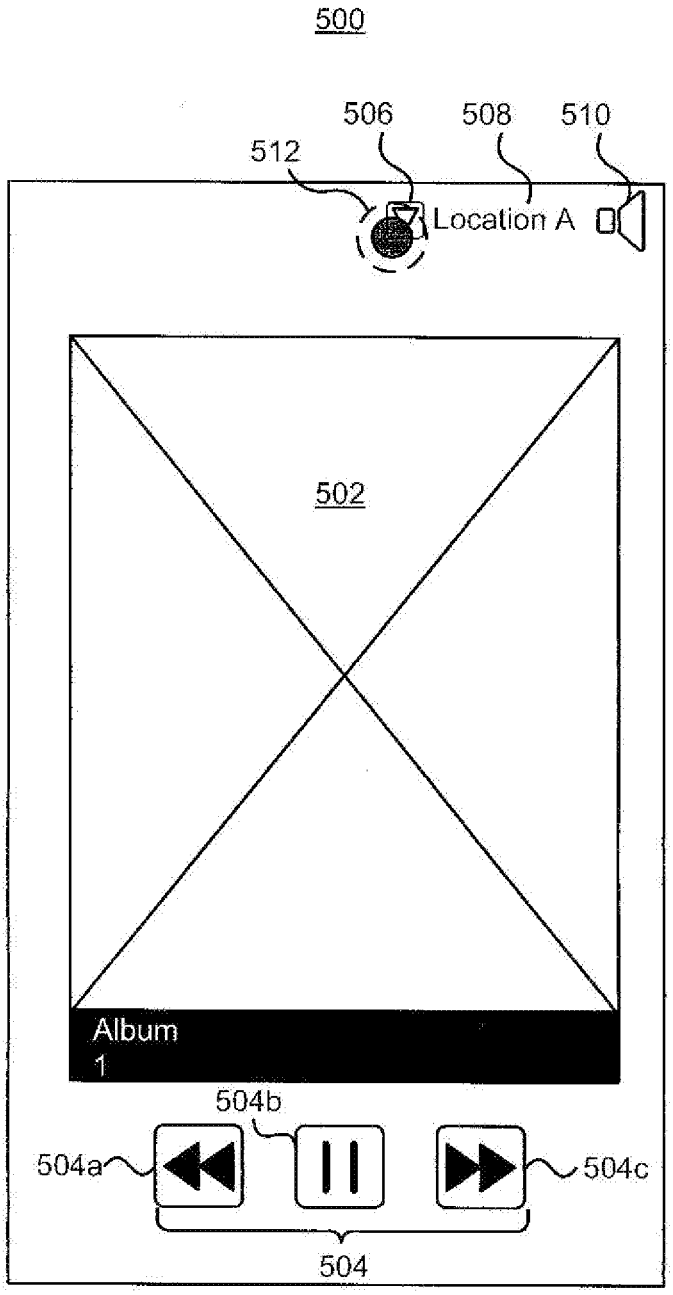
FIGS. 5-9 depict user interfaces for controlling audio playback.
Figure 6:
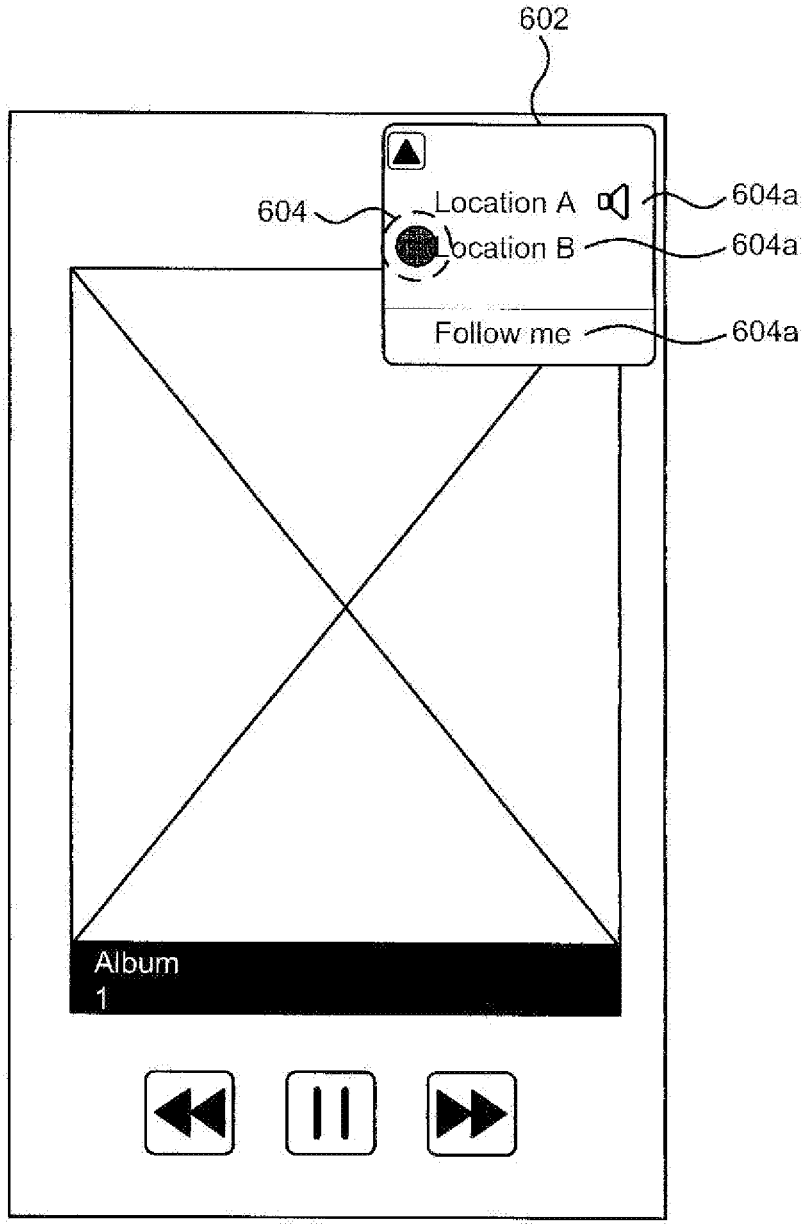

FIGS. 5-9 depict user interfaces for controlling audio playback. The user interfaces 500, 600, 700, 800, 900 may be generated by the player control functionality on a mobile device. As will be appreciated, the user interfaces are only illustrative and the specific graphical representations may vary. As depicted in FIG. 5, the user interface may present a graphical representation 502 of the album, song, or audio currently being played. The user interface may further include various playback controls 504 such as a rewind button 504*a*, a play or pause button 504*b*, and a forward button 504*c*. It will be appreciated that other interfaces may be provided to facilitate the playback of audio. For example, the user interface may provide playlist functionality, etc. The user interface may also include functionality for controlling playback at the different speaker locations. As depicted, a drop down item 506 may be provided for the different speaker locations 508 and may also include icons or other graphics 510 providing information about the speaker location. For example, the graphic 510 may provide an indication of what speaker locations are currently playing audio. As depicted, a user may click the drop down menu, indicated by touch contact point 512, which causes the menu items 602 to be displayed. As depicted the menu items 502 may include indications of the different speaker locations 602*a*, 602*b* that can be controlled. Additionally, the menu may include menu item 602*c* that indicates a 'follow me' option which causes the speaker locations to which music is being streamed to be selected based on the location of the mobile device. The user may select one of the menu items, depicted by touch contact point 604.

Figure 7:
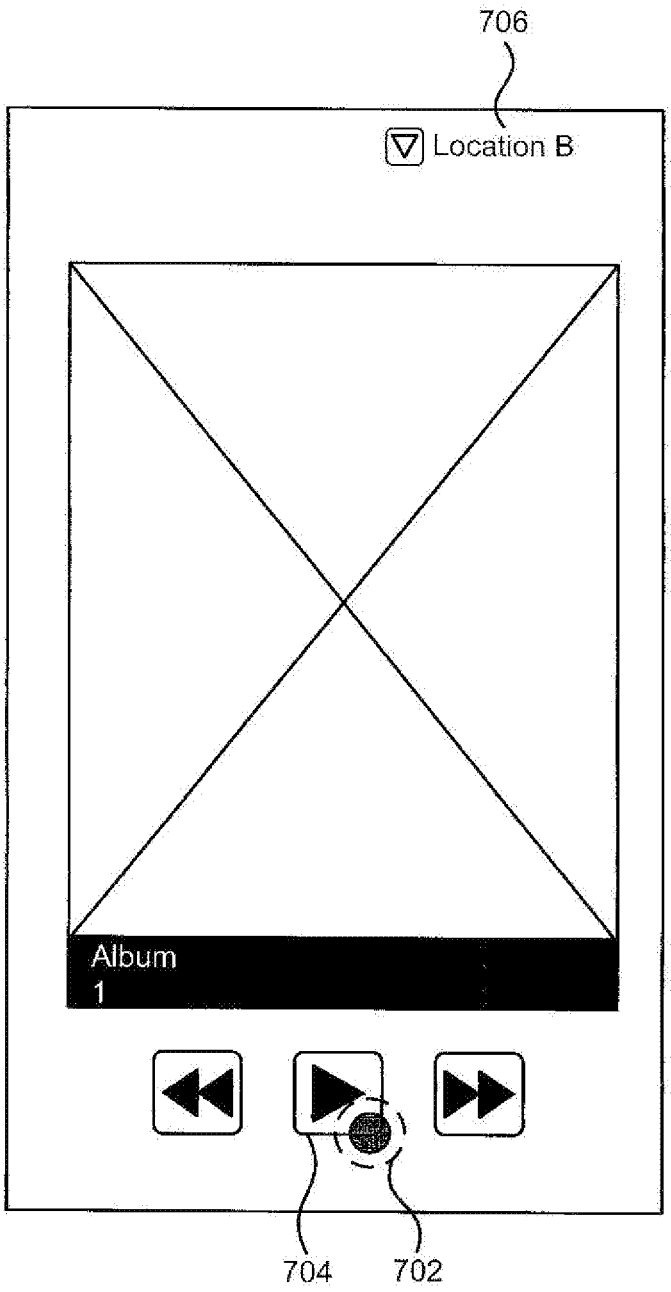

As depicted in FIG. 7, the location being controlled may be changed and reflected in the user interface 706. The second speaker location may not currently be playing music and as such the user interface may indicate a play button 704 in place of the pause button 704*b*. The user may play a song, such as the song currently being played at speaker location A, by selecting the play button as depicted by touch contact point 702.

Figure 8:
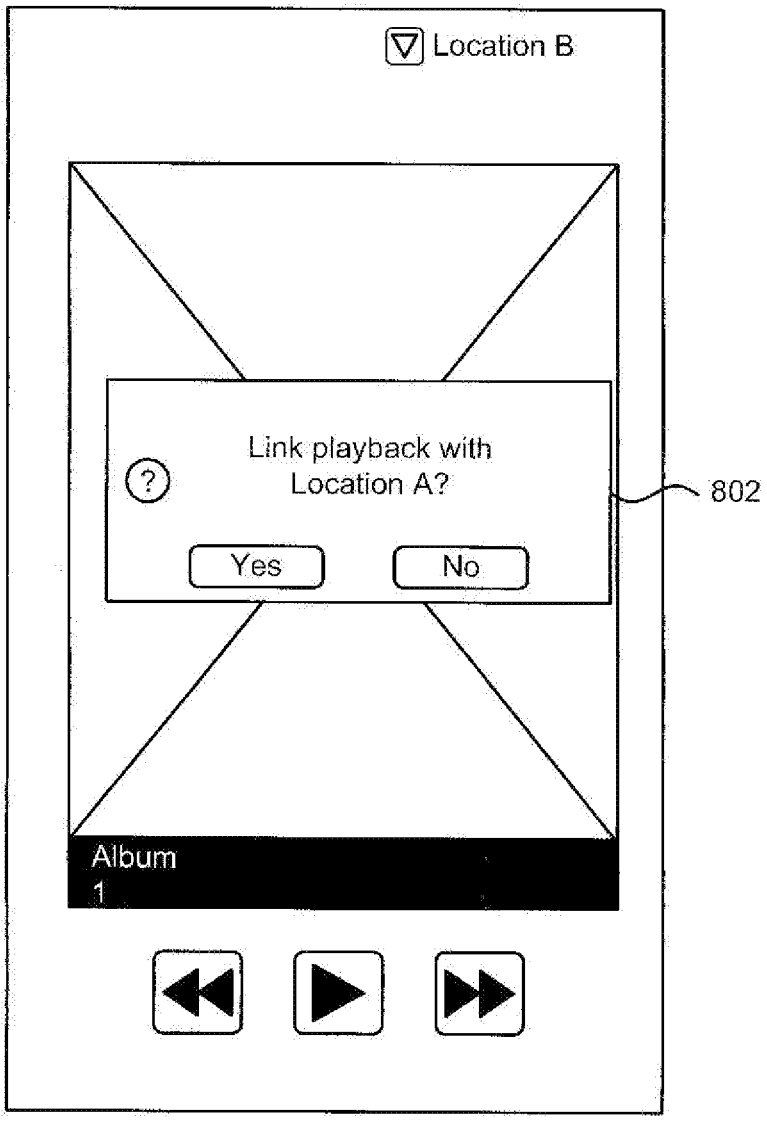

As depicted in FIG. 8, when controlling playback of a second location, the user may be presented with an option 802 for linking playback of the current location with the other location playing music. If the user selects to link the playback, the audio may be played at both speaker locations simultaneously. Alternatively, if the user does not link playback of the different locations, the audio played at each speaker location may be different.

Figure 9:
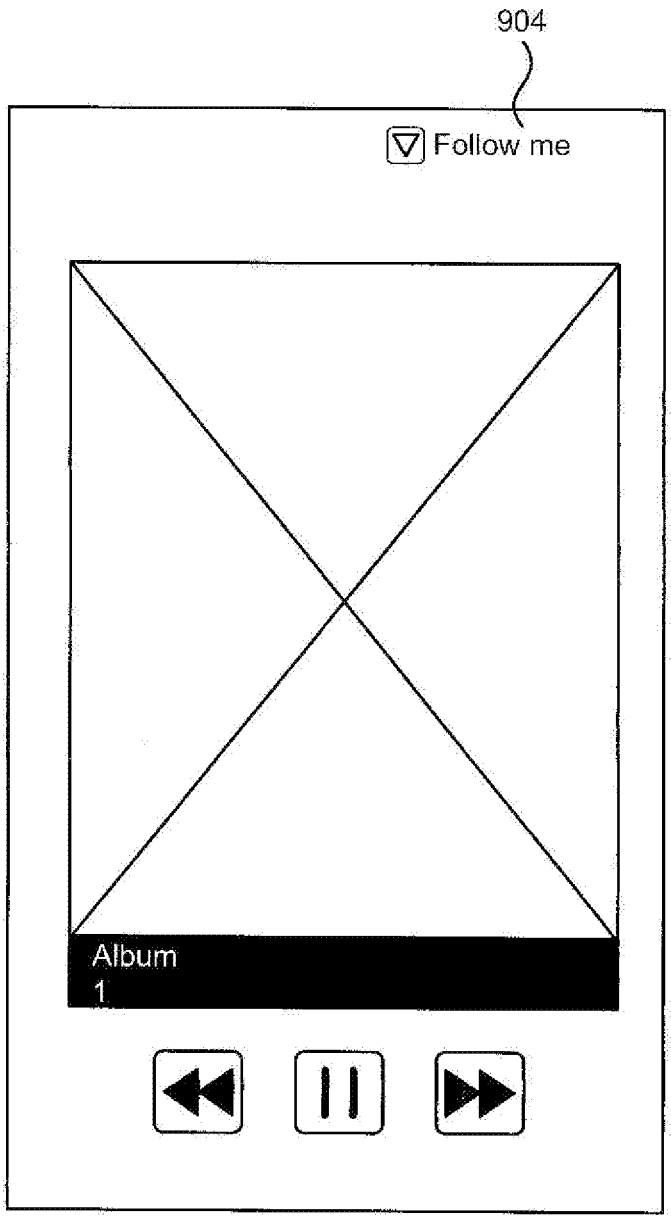

FIG. 9 depicts the selection of the follow me option 904. When selected, the option causes the mobile device to detect LBS signals broadcast by speaker devices and based on the determined location of the mobile device, or more particularly, on a determined proximity of the mobile device to the speaker device, the location of the speakers which are currently playing back audio can be controlled. As the mobile device switches locations, the playback transitions to play audio on the speakers of the new location. The transition between speaker locations can occur seamlessly since clocks of both speaker devices are synchronized to a common clock and as such can synchronize playback of the audio.

Figure 10:
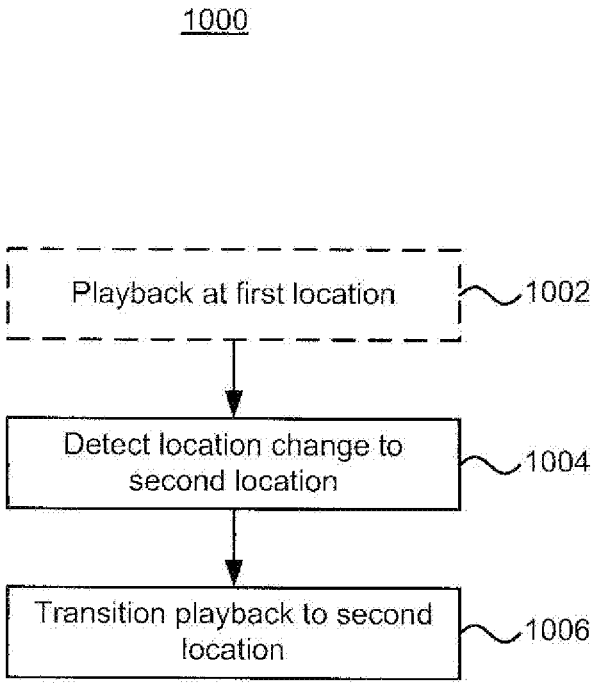
FIG. 10 depicts a method for controlling audio playback.

FIG. 10 depicts a method for controlling audio playback between speaker devices with synchronized clocks. The method 1000 may occur when audio is being played back at a first location 1002. The mobile device controlling the playback detects a change of location to a second location 1004. The location change can be detected at the mobile device by detecting LBS signals that are broadcast by speaker devices. Based on one or more received LBS signals, the mobile device may determine a proximity to the different speaker locations. Based on the determined proximity, the current location may be determined and updated. Once the location change is detected, the mobile device transitions audio playback from the current first location and the second speaker location 1004. The playback transition may be accomplished by stopping playback at the location currently playing music and playing music at the second location.

Figure 11:
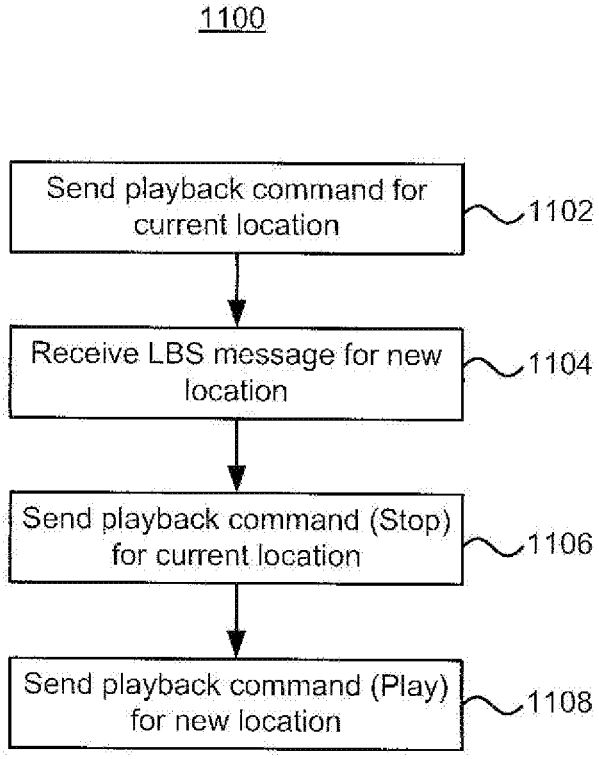
FIG. 11 depicts a further method for controlling audio playback

FIG. 11 depicts a further method for controlling audio playback. The method 1100 begins when a mobile device sends a playback command for a current location (1102). The playback command may be sent from the mobile device to a player server. The mobile device may receive one or more LBS signals broadcast from speaker devices at different locations (1104).

The mobile device uses the received LBS signals to determine the new location and a transition command may be sent from the mobile device to the player server, causing the player server to transmit a playback 'Stop' command for the current location (1106) as well as a playback 'Play' command for the new location (1108). The timing of the 'Stop' and 'Play' command may be offset so that the 'Stop' command occurs after the 'Play' command so that the audio is played momentarily on speakers at both locations.

As described above, a mobile device may be used in determining a users location relative to one or more speakers, which in turn may be used to determine one or more playback locations for audio. The mobile device is described as being provided by a smart phone, however, it may be provided by various devices, such as for example a wearable device like a smart watch, fitness tracking band. Additionally, the functionality described above as being provided by the mobile device may be provided by a combination of interacting devices. For example, the functionality describe above may be provided by a smart phone device and a connected smart watch. The smart watch or other wearable device may be used to determine a distance of the user to the speakers. The wearable device may be more likely to be carried by the user and as such provide a more accurate distance measurement from the user to the speakers.

It should be noted that the algorithms illustrated and discussed herein as having various modules which perform particular functions and interact with one another. It should be understood that these modules are merely segregated based on their function for the sake of description and represent computer hardware and/or executable software code which is stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A method for controlling media playback at one or more speaker devices, the method comprising:

playing back audio at a first speaker device of a plurality of speaker devices, the first speaker device associated with a first location;

detecting a location change of a mobile device from a first location to a second location based on one or more location based services (LBS) signals transmitted by a plurality of speaker devices; and transitioning media playback from the first speaker device to a second speaker device of the plurality of speaker devices associated with the second location;

wherein transitioning media playback comprises:

adjusting playback speed based on an amount of buffered media, wherein adjusting playback speed comprises adjusting the playback speed according to playback speed factor α:

$$\alpha = 1 + \frac{(buffer_{threshold} - buffer_{current})}{buffer_{threshold}}$$

where:

$buffer_{threshold}$ is a buffer level required to sustain normal playback of the media; and $buffer_{current}$ is the current amount of media data in the buffer.

2. The method of claim 1, wherein transitioning playback comprises stopping playback at the first speaker device and starting playback at the second speaker device.

3. The method of claim 1, wherein each of the speaker devices transmits LBS signals including a unique identifier associated with a location of the respective speaker device.

4. The method of claim 1, wherein each of speaker devices comprises a respective clock that is each synchronized to a common clock.

5. The method of claim 1, wherein transitioning media playback comprises:

streaming media to the one or more different speaker devices;

beginning playback of the media at a specified time of a synchronized internal clock.

6. The method of claim 1, further comprising:

adjusting a volume of one or more of the speaker devices playing back media based on a distance of the mobile device from the respective speaker device.

7. A method for controlling media playback at one or more speaker devices, the method comprising:

playing back audio at a first speaker device of a plurality of speaker devices, the first speaker device associated with a first location;

detecting a location change of a mobile device from a first location to a second location based on one or more location based services (LBS) signals transmitted by a plurality of speaker devices; and transitioning media playback from the first speaker device to a second speaker device of the plurality of speaker devices associated with the second location;

adjusting a volume of one or more of the speaker devices playing back media based on a distance of the mobile device from the respective speaker device, wherein adjusting the volume comprises adjusting the volume according to:

$$L_n = L_0 + 10\log\left(\frac{d_0}{d_n}\right)$$

where:

$L_0$ is a desired volume level, in dB, at a selected one of the plurality of speaker devices;

$d_0$ is a distance from the mobile device to the selected speaker device;

$L_n$ is the volume of the $n^{th}$ speaker device in dB; and $d_n$ is a distance from the mobile device to the $n^{th}$ speaker device, where the plurality of speaker devices, other than the selected speaker device, are enumerated from n=1 to N−1 with N being the number of speaker devices playing back media.

8. The method of claim 7, wherein transitioning playback comprises stopping playback at the first speaker device and starting playback at the second speaker device.

9. The method of claim 7, wherein each of the speaker devices transmits LBS signals including a unique identifier associated with a location of the respective speaker device.

10. The method of claim 7, wherein each of speaker devices comprises a respective clock that is each synchronized to a common clock.

11. The method of claim 7, wherein transitioning media playback comprises:

streaming media to the one or more different speaker devices;

beginning playback of the media at a specified time of a synchronized internal clock;

adjusting playback speed based on an amount of buffered media.

* * * * *